US005692251A

United States Patent [19]

Page

[11] Patent Number: 5,692,251

[45] Date of Patent: Dec. 2, 1997

[54] SHAMPOO BOWL HEADREST

[76] Inventor: Timothy Allen Page, 8211 Sidbury Rd., Wilmington, N.C. 28405

[21] Appl. No.: 784,356

[22] Filed: Jan. 23, 1997

[51] Int. Cl.[6] ..... A47K 1/04; A47K 3/12

[52] U.S. Cl. ..... 4/523; 4/516

[58] Field of Search ..... 4/515, 516, 519, 4/523, 583, 517, 518, 520, 521, 522

[56] References Cited

U.S. PATENT DOCUMENTS

| | | | |
|---|---|---|---|
| 570,107 | 10/1896 | Slee | 4/523 |
| 1,510,647 | 10/1924 | Bomar | 4/583 |
| 1,588,293 | 6/1926 | Bailey | 4/523 |
| 1,602,240 | 10/1926 | Miller | 4/583 |
| 2,526,601 | 7/1950 | Smalls | 4/523 |
| 2,732,565 | 1/1956 | Weber | 4/583 |
| 3,341,866 | 9/1967 | Wright | 4/583 |
| 4,630,323 | 12/1986 | Sage et al. | 4/583 |

*Primary Examiner*—Henry J. Recla
*Assistant Examiner*—Charles R. Eloshway

[57] ABSTRACT

A headrest which supports the weight of the head and relieves pressure on the neck during hair treatment procedures. This headrest is made of durable polyethylene with the base anchoring in the sink drain, extending to the front wall, and connecting to a post which is adjustable for length into the sink bowl. A round disk attaches to the post for ultimate comfort and height adjustment capabilities above the bottom wall of the sink. This disk has a skirt sleeve to avoid entanglement of hair, and allows "hands free" use during treatment procedures.

6 Claims, 2 Drawing Sheets

SHAMPOO BOWL HEADREST

BACKGROUND OF THE INVENTION

This invention relates to the continuing problem of comfortably supporting the head during hair treatment procedures, with the purpose of taking the pressure off one's neck.

Patents have been issued targeting this ongoing dilemma, but none have the design and benefits included with this present invention.

Grim, U.S. Pat. No. 4,352,216, and Tafur, U.S. Pat. No. 5,239,711 use mesh-type supports which are attached by hooks to the sink rim.

Verallo, U.S. Pat. No. 5,177,820 uses a sink mount to attach his support bender columns and headrest which partially envelops the head of the user.

Porco, U.S. Pat. No. 4,922,558 uses two frame members, each with two elongated side legs joined by crossbars. A web-like support element extends between the frame members, with suction cups positioned on the end of each side leg in the sink basin.

Schnell, U.S. Pat. No. 3,026,537 uses a U-shaped device attached to an extending lower leg secured to the sink with a suction cup. This leg is adjustable for different sink depths.

Smithers, U.S. Pat. No. 4,998,303 uses a perforated headrest plate attached to a U-shaped frame, engageable with the rim of the sink. A support extends against the interior wall to adjustably position the device.

BRIEF SUMMARY OF THE INVENTION

It is an object of the present invention to overcome the deficiencies of related inventions, and provide a headrest for shampoo bowls which will easily and simply support the weight of the head and therefore relieve the pressure on one's neck during hair treatment procedures.

Another object of this invention is providing a headrest for shampoo bowls which is adjustable for different neck lengths.

Another object of this invention is providing a headrest for shampoo bowls which is adjustable to different heights, to be compatible with various chair designs.

Another object of this invention is providing a headrest for shampoo bowls which is secured to the sink drain for stability and ease of installation.

Another object of this invention is providing a headrest for shampoo bowls which provides a round disk attached to a support post, which in turn is attached to the base, and therefore comfortably supports the head.

A further object of this invention is providing a headrest for shampoo bowls which expedites efficiency, and is durable in construction, yet impervious to chemicals which may be found in hair care products.

Additional objects of this invention will become apparent throughout the detailed descriptions of the specification.

The above related objects and other objects of this invention are all accomplished with a head support comprised of three parts: 1.) a base, 2.) a support post, and 3.) a head disk. As a whole, they are secured in the sink drain with a base end cup, including holes for water drainage; made of anti-skid material to further enhance stability; and fully adjustable lengthwise and for height, with angles of measurement commensurate with different neck lengths and chair designs.

DETAILED DESCRIPTION

Figure 1:
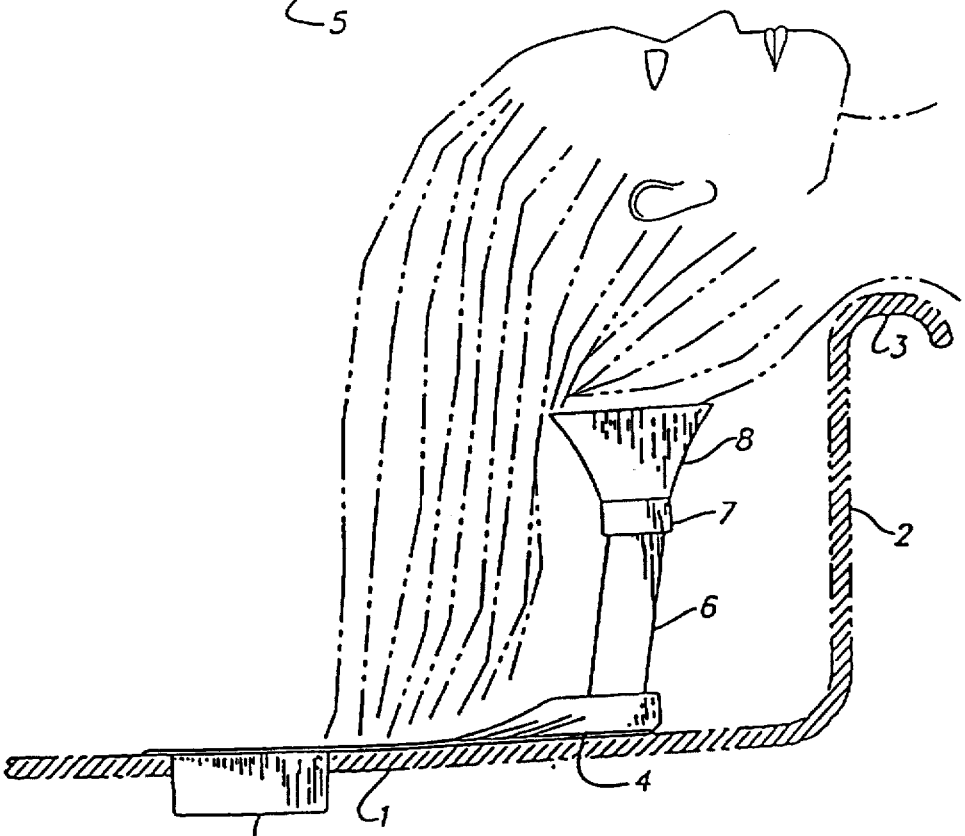
FIG. 1 is a pictorial view showing the customer's head being supported on the headrest.

The drawings contained herein will be referred to in numeric sequence to provide these descriptions. FIG. 1 shows a customers head laying in the depression 3 of a shampoo bowl of which is shown a from wall 2 and a bottom wall 1. The customer's head is resting on a head disk 8 which has a skirt 7 to prevent hair entanglement. The head disk 8 is connected to an upright support 6 which in turn is fitted into the main body 4. The main body 4 is stabilized by inserting the drain cup end 5 into the sink drain for anchorage purposes. The main body 4 is made of linear low density polyethylene, as is the head disk 8. The upright support 6 is made of linear high density polyethylene. These materials will stand up to the harsh chemicals that can be found in hair treatment products.

Figure 2:
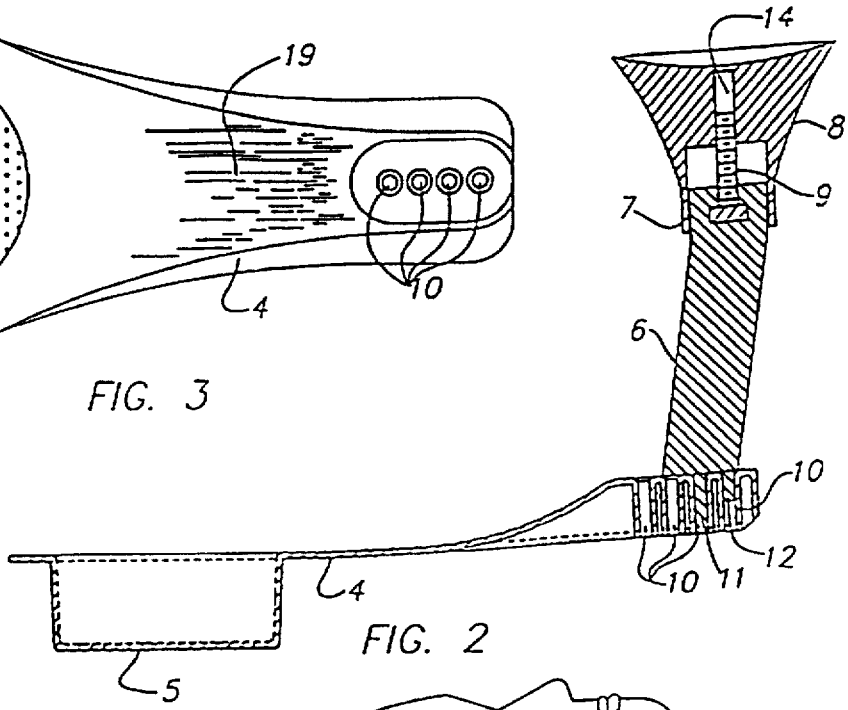
FIG. 2 is a perspective view of all the parts of the headrest, as one, as it would appear before installation.

FIG. 2 shows the three individual parts of the headrest as one, as it will combine before placement into the shampoo bowl. The drain cup end 5 will anchor into the sink drain opening for stability and the bottom of the main body 4 is designed to prevent slippage along the bottom wall 1 of the sink. The head disk 8 will thread down onto a threaded brass stud 9 for height adjustment into a threaded opening 14 in the head disk 8. The head disk 8 has a skirt 7 feature which is designed to prevent hair entanglement around the threaded stud 9. Two brass studs 11, 12 protruding from the bottom of the upright support 6 fit into the hole shafts 10 in the main body 4 snugly to prevent twisting or rotation of the upright support 6. There are a series of these hole shafts 10 to allow for backward or forward movement adjustments for different neck lengths.

Figure 3:
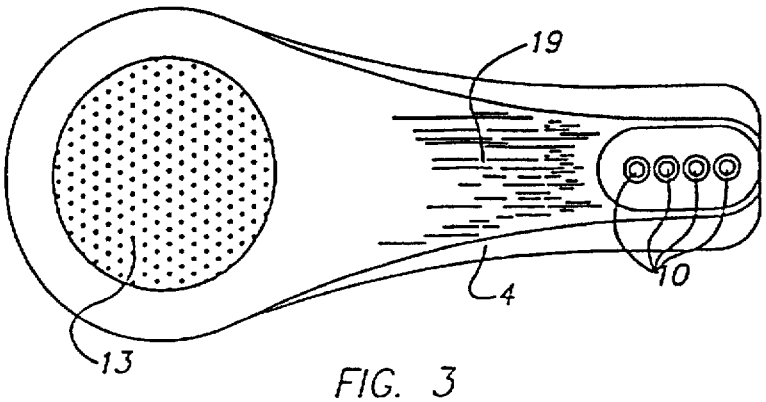
FIG. 3 is a top view of the main body of the headrest, showing water drain holes and the tops of the holes used for lengthwise adjustments.

FIG. 3 shows the top of the drain cup end 5 which is perforated with drain holes 13 to allow for water drainage during hair treatment procedures. The upper part 19 of the main body 4 is aerodynamically shaped to be esthetically pleasing to the eye. The tops of the hole shafts 10 show that the distance of needed adjustments are minimal under most circumstances.

Figure 4:
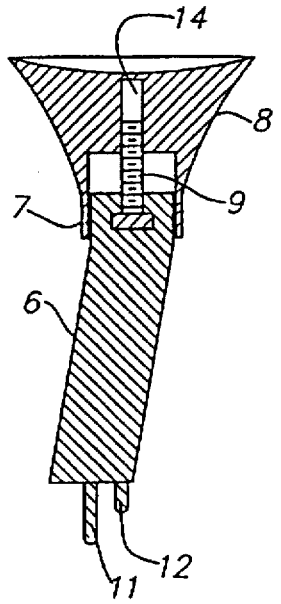
FIG. 4 is a side view of the upright support with the head disk attached to a metal bolt inside the support to allow for up and down level adjustments by turning said disk clockwise or counter-clockwise.

FIG. 4 shows the head disk 8 threaded onto the threaded brass stud 9 inserted into the top of the upright support 6. It is necessary to have this up and down adjustment capability to allow for different sink designs and chair models. The threaded opening 14 in the underside of the head disk 8 allows for these different heights. The protruding brass studs 11, 12 from the bottom of the upright support 6 fit firmly into the hole shafts 10 of the main body 4.

Figure 5:
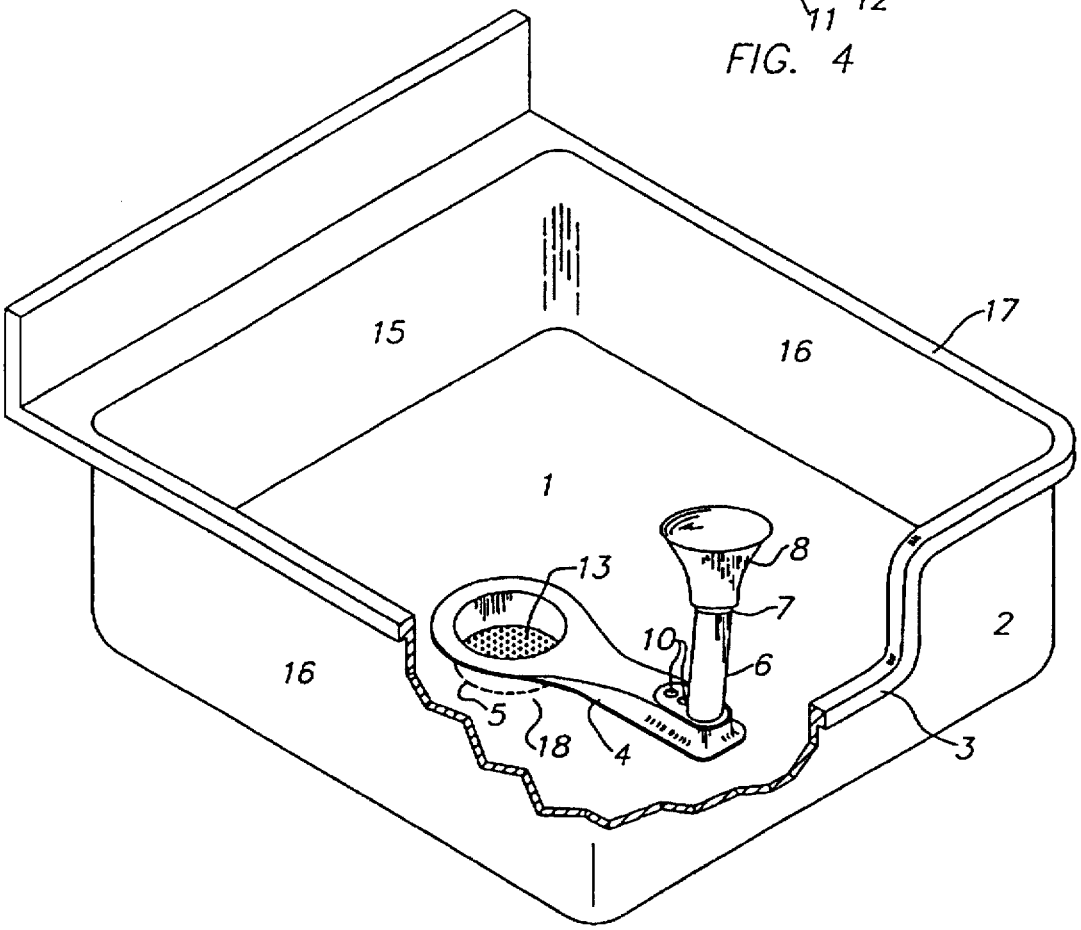
FIG. 5 is a perspective view with a cutout to show the present invention installed in a shampoo bowl.

FIG. 5 is a view of all parts of the headrest interconnected to show the present invention installed in a shampoo bowl 17. A person's head would lay in the depression 3 of the bowl 17 which is comprised of a back wall 15, opposing side walls 16, a front wall 2, and a bottom wall 1. The customer's head would rest on the head disk 8 which in turn would be threaded onto the upright support 6, with the skirt 7 feature preventing hair tangles. Depending on the customer's neck length, the upright support 6 can be adjusted lengthwise from the front wall 2 to fit for comfort, using the hole shafts 10 on the main body 4. The drain cup end 5 of the main body 4, of which the drain cup end 5 is perforated with drain holes 13, is seated in the sink drain hole 18 to allow for water drainage.

I claim:

1. A headrest for a shampoo bowl which has a rim for supporting the neck of a person such that the person's head is suspended over the bowl, said headrest supporting a person's head during hair treatment procedures, so as to provide customer comfort and ease of workmanship, said headrest comprising:

(a) a main body adapted to lie along the bottom wall of the bowl;

(b) a drain cup end attached to the main body to anchor the main body to the bowl drain;

(c) an upright support attached to the main body having a head disk joined thereto shaped to encompass the back ball of the person's skull structure.

2. The headrest of claim 1 wherein said head disk is vertically adjustable.

3. The headrest of claim 1 wherein said upright support is made of solid material to hold different head weights and is laterally adjustable on the main body to accommodate different neck lengths.

4. The headrest of claim 1 wherein the main body is made of anti-skid material to provide non-slipping stability.

5. The headrest of claim 1 is completely portable.

6. The headrest of claim 1 wherein said main body, said drain cup, said upright support, and said head disk are made from material which is chemically resistant to hair treatment additives.

* * * * *